US007631502B2

(12) United States Patent
Burd et al.

(10) Patent No.: US 7,631,502 B2
(45) Date of Patent: Dec. 15, 2009

(54) LOCAL COOLING HOLE PATTERN

(75) Inventors: Steven W. Burd, Cheshire, CT (US); Albert K. Cheung, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 756 days.

(21) Appl. No.: 11/302,586

(22) Filed: Dec. 14, 2005

(65) Prior Publication Data

US 2007/0130953 A1 Jun. 14, 2007

(51) Int. Cl.
*F02C 1/00* (2006.01)
*F02G 3/00* (2006.01)

(52) U.S. Cl. ..... 60/754; 60/752

(58) Field of Classification Search ..... 60/752–760, 60/772

See application file for complete search history.

(56) References Cited

U.S. PATENT DOCUMENTS

| | | | | |
|---|---|---|---|---|
| 5,233,828 | A | 8/1993 | Napoli | |
| 5,918,467 | A | 7/1999 | Kwan | |
| 6,145,319 | A * | 11/2000 | Burns et al. | 60/755 |
| 6,205,789 | B1 * | 3/2001 | Patterson et al. | 60/754 |
| 6,266,961 | B1 * | 7/2001 | Howell et al. | 60/752 |
| 6,408,629 | B1 | 6/2002 | Harris et al. | |
| 6,434,821 | B1 * | 8/2002 | Nelson et al. | 29/888.01 |
| 6,513,331 | B1 * | 2/2003 | Brown et al. | 60/754 |
| 6,655,146 | B2 * | 12/2003 | Kutter et al. | 60/752 |
| 6,655,149 | B2 * | 12/2003 | Farmer et al. | 60/754 |
| 7,086,232 | B2 * | 8/2006 | Moertle et al. | 60/752 |
| 7,093,439 | B2 * | 8/2006 | Pacheco-Tougas et al. | 60/752 |
| 7,216,485 | B2 * | 5/2007 | Caldwell et al. | 60/772 |
| 2006/0196188 | A1 * | 9/2006 | Burd et al. | 60/754 |

FOREIGN PATENT DOCUMENTS

| | | |
|---|---|---|
| JP | 60-82281 | 5/1985 |
| JP | 8-75166 | 3/1996 |
| JP | 8-135968 | 5/1996 |
| JP | 2000-130758 | 5/2000 |
| JP | 2003-114023 | 4/2003 |

* cited by examiner

*Primary Examiner*—William H Rodríguez
(74) *Attorney, Agent, or Firm*—Carlson, Gaskey & Olds

(57) ABSTRACT

A combustor assembly includes an inner and an outer liner defining a combustion chamber. The inner and outer liner includes a plurality of cooling holes that are spaced a specified distance apart. The cooling holes include a specified inclination angle and circumferential angle. A first group of cooling holes is spaced apart according to a uniform geometric pattern and density. A second group disposed between the first group and some structural feature within the liner assembly is disposed at a non-uniform pattern and a hole density equal to the density of the first group of cooling holes. The non-uniform cooling hole arrangement increases cooling flow effectiveness to accommodate local disturbances and thermal properties.

21 Claims, 4 Drawing Sheets

LOCAL COOLING HOLE PATTERN

BACKGROUND OF THE INVENTION

This invention relates generally to a combustor liner for a gas turbine engine. More particularly, this invention is a cooling hole configuration for providing a desired cooling airflow proximate to cooling airflow disrupting features of a combustor liner.

Typically, a combustor module for a gas turbine engine includes an outer casing and an inner liner. The liner and the casing are radially spaced apart to form a passage for compressed air. The liner forms a combustion chamber within which compressed air mixes with fuel and is ignited. The liner includes a hot side exposed to hot combustion gases and a cold side facing the passage formed between the liner and the casing. Liners can be single-wall or double-wall construction, single-piece construction or segmented construction in the form of discrete heat shields, panels or tiles.

Typically, a plurality of cooling holes supply a thin layer of cooling air that insulates the hot side of the liner from extreme combustion temperatures. The liner also includes other openings much larger than the cooling holes that provide for the introduction of compressed air to feed the combustion process. The thin layer of cooling air can be disrupted by flow around the larger openings potentially resulting in elevated liner temperatures adjacent the larger openings. Further, the liner includes other structural features such as seams and rails that disrupt cooling airflow causing elevated temperatures. Elevated or uneven temperature distributions within the liner can promote undesired oxidation of the liner material, coating-failure or thermally-induced stresses that degrade the effectiveness, integrity and life of the liner.

It is known to arrange cooling holes in a different grouping densities around larger openings or other features that may disrupt cooling airflow. The increased number of cooling holes around larger openings and other features increase airflow preferentially in these areas and are somewhat effective in maintaining the desired cooling airflow.

Disadvantageously, the greater cooling airflow provided around such openings and other disrupting configurations, utilizes a large portion of the limited quantity of cooling air provided to the combustor liner. The increased demand for cooling airflow in the localized areas around larger opening and disruptions reduces the overall cooling airflow that is available for the remaining portions of the liner assembly. The amount of cooling airflow is limited by the design of the combustor liner and increases in cooling airflow requirements can impact other design and performance requirements.

Accordingly, it is desirable to develop a combustor liner that improves cooling layer properties around cooling airflow disrupting structures to eliminate uneven temperature distributions or undesirable temperature levels without substantially increasing cooling airflow requirements.

SUMMARY OF THE INVENTION

An example combustor assembly according to this invention includes a plurality of cooling holes for providing film cooling of a combustor liner that are preferentially oriented relative to a flow-disrupting structure.

A combustor liner according to this invention utilizes groups of cooling holes that are provided in a generally uniform density with changes to the circumferential angle of some cooling holes to accommodate specific structural features that create disruptions in cooling airflow. The example combustor liner assembly includes a first plurality of cooling holes within the combustor liner that are angled through the liner at a first compound angle to provide a flow and layer of cooling air. The compound angle for each cooling hole includes a first circumferential angle component and a first inclination angle component. The first group of cooling holes is distributed throughout the combustor liner in regions spaced apart from structural features affecting cooling airflow. Each of the first group of cooling holes includes a common compound angle with substantially common circumferential and inclination angle components.

A second group of cooling holes is disposed adjacent to structural features that affect cooling airflow at a second compound angle relative to the structural features. The second group of cooling holes includes a second circumferential direction corresponding to the proximate structural feature. Each of the cooling holes in the second group also includes an inclination angle that is substantially the same as that of the first group of cooling holes. The second group of cooling holes surrounds the structural formations within the liner assembly to provide a non-uniform and structural feature specific arrangement of cooling holes to provide the cooling airflow that maintains desired wall temperatures and increases cooling film effectiveness without significantly increasing the amount of cooling airflow required.

Accordingly, the non-uniform cooling hole array in regions adjacent specific structural features of the liner assembly promote improved cooling airflow around specific structural features that increases cooling film effectiveness without increasing coolant air requirements.

These and other features of the present invention can be best understood from the following specification and drawings, the following of which is a brief description.

DETAILED DESCRIPTION OF THE PREFERRED EMBODIMENT

Figure 1:
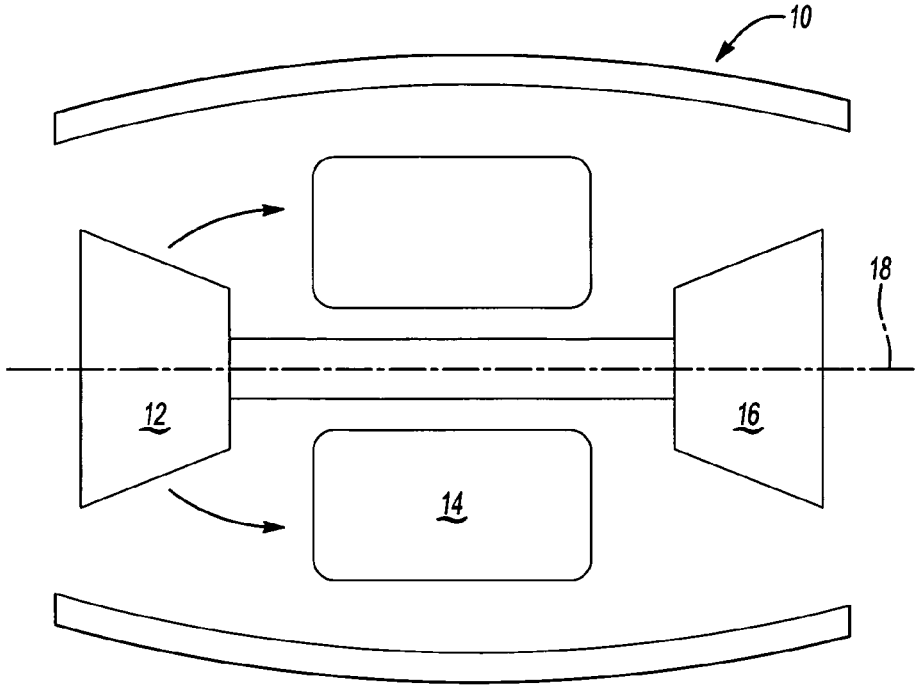
FIG. 1 is a schematic view of a turbine engine assembly according to this invention.

Referring to FIG. 1, a turbine engine assembly 10 includes a fan, a compressor 12 that feeds compressed air to a combustor 14. Compressed air is mixed with fuel and ignited within the combustor to produce hot gasses that are then driven past a turbine 16. The schematic representation of the turbine engine assembly 10 is intended for descriptive purposes, as other turbine engine assembly configurations will also benefit from the disclosures of this invention.

Figure 2:
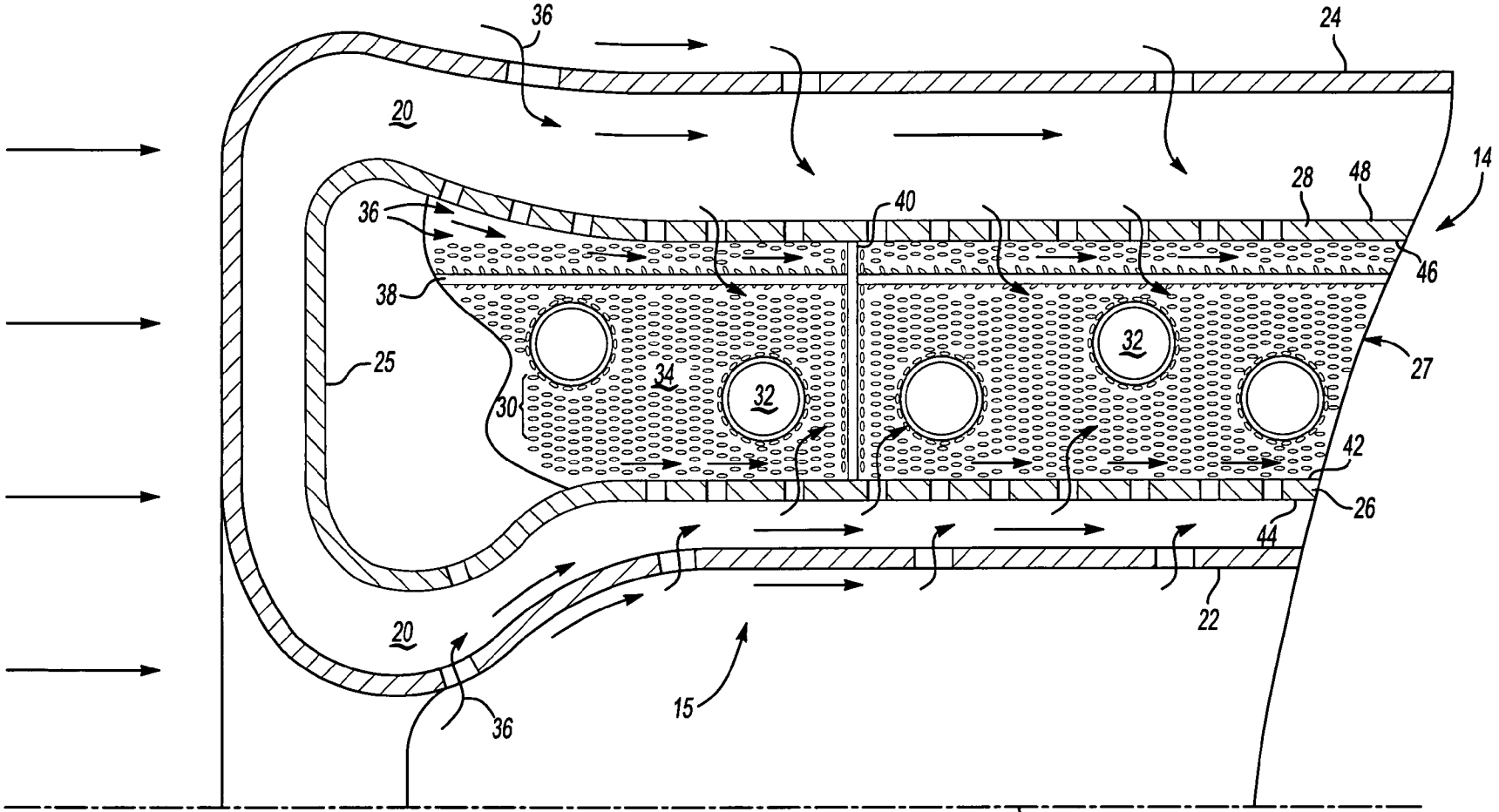
FIG. 2 is a schematic cross-sectional view of a combustor assembly according to this invention.

Referring to FIG. 2, the combustor assembly 14 includes a dual-wall liner assembly 15. The liner assembly 15 includes an inner shell 22 and an outer shell 24. The outer shell 24 and inner shell 22 are spaced radially apart from an inner heat shield 26 and an outer heat shield 28. The inner shell 22 and outer shell 24 are spaced a radial distance apart to define an air passage 20 between the outer heat shield 28 and the inner heat shield 26.

The example combustor assembly illustrated is disposed annularly about the axis 18. The radial space in between the shells 22, 24 and the heat shields 26, 28 define an air passage 20. Cooling air 36 flows through the air passage 20 to provide cooling for the heat shields 26, 28. The heat shields 26,28 are attached at a forward end by a dome plate or bulkhead assembly 25. The combustion chamber 34 is defined by the heat shields 26, 28 and is open at an aft end 27 to allow the exhaust of combustion gasses.

A layer of cooling air is supplied along a hot side surface 46, 42 of the heat shields 26, 28. Cooling air 36 is communicated from a cold side 48, 44 through each of the heat shields 26, 28 to the hot side 46, 42 within the combustor chamber 34. The layer of cooling air flows along the hot side surfaces 42, 46 toward the aft end 27 to provide insulation for the heat shields 26, 28.

Each of the heat shields 26, 28 includes a plurality of openings and other structural features. These openings include dilution air openings 32 and cooling air openings 30. The cooling air openings 30 are disposed within the heat shields 26, 28 and are provided to communicate air that generates the insulating layer of cooling air. Other openings include the dilution openings 32 that provide air to aid the combustion process. The dilution openings 32 are much larger than the cooling air openings 30. Airflow through the dilution holes 32 can disrupt the cooling airflow along the surfaces of the heat shields 28, 26.

Figure 3:
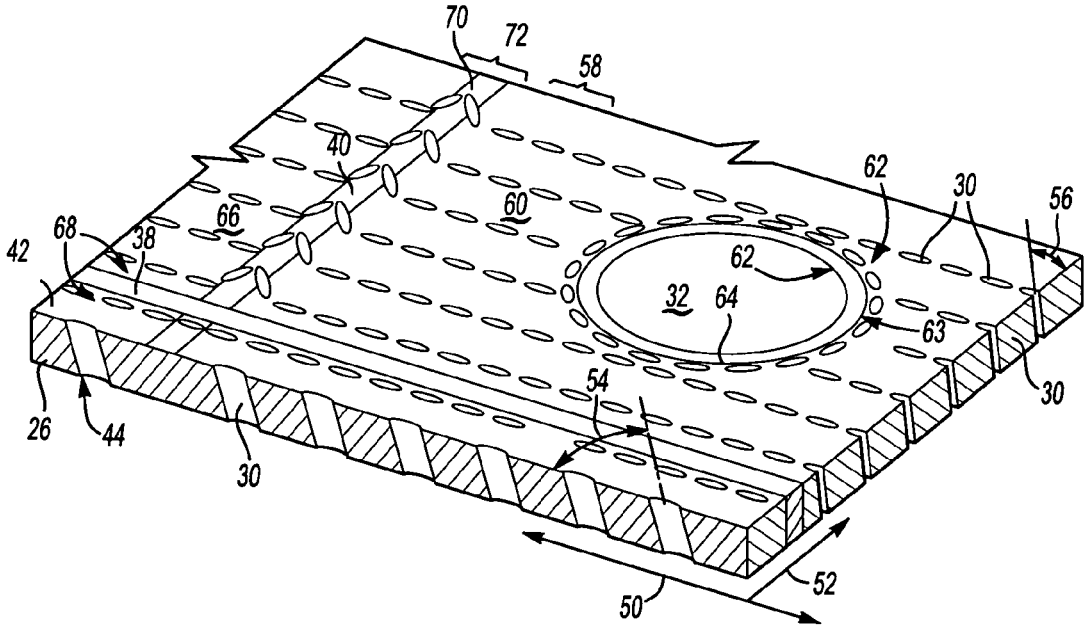
FIG. 3 is a schematic view of a portion of an inner liner assembly according to this invention.

Referring to FIG. 3, the inner heat shield 26 includes the hot side surface 42 and the cold side surface 44. Cooling air 36 flows from the cold side surface 44 to the hot side surface 42. The dilution opening 32 is much larger than the cooling openings 32. Further, within the portion of the heat shield 26 are a rail assembly 38 and a seam 40. The rail assembly 38 and the seam 40 are areas in the liner assembly of non-uniform material thickness that creates specific challenges to maintaining uniform temperatures of the heat shield 26.

The cooling holes 30 are distributed in a substantially uniform geometric pattern and density within the heat shield 26. However, in locations proximate to the various structural features such as the dilution opening 32, the rail assembly 38 and the seam 40, the cooling holes 30 are distributed in a non-uniform matter to facilitate cooling air flow 36 adjacent these features of the liner assembly 15.

A first group 58 of cooling holes 30 is disposed in a generally uniform geometric pattern within a first region 60. The first region 60 includes all of the regions within the heat shield 26 that are not disposed adjacent one of the structural features such as the rail 38 or the dilution opening 32. A second region 64 is disposed between the first region 60 and the dilution opening 32.

Each of the cooling holes 30 is disposed at an angular orientation from the cold side 44 to the hot side 42 of the inner heat shield 26. The angular orientation provides the directional flow of the cooling airflow 36, thereby generating the insulating layer of air along the hot side 42. Each of the cooling holes 30 is disposed at a compound angle including an inclination angle 54 and a circumferential angle 56. The inclination angle 54 is disposed relative to a longitudinal axis 50 of the combustor assembly 14. The circumferential angle 56 is disposed relative to a transverse or circumferential axis 52 disposed transverse to the to the axis 50. Each cooling hole 30 is disposed within the heat shield 26 at the compound angle including components angled relative to the longitudinal axis 50 and the circumferential axis 52. Tailoring of the inclination angle 54 and circumferential angle 56 provides for directing airflow over areas along the hot side surface 42.

Figure 4A:
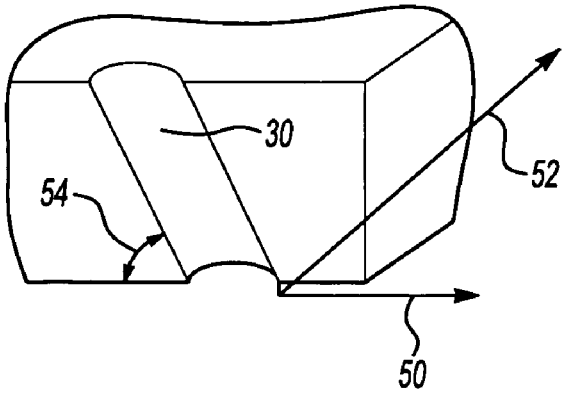
FIG. 4*a* is a schematic view of a cooling hole angled within a liner wall according to this invention.

Referring to FIG. 4*a* a large schematic view of a cooling hole 30 disposed within the inner heat shield 26 is shown. The cooling hole 30 is disposed at the inclination angle indicated at 54. Preferably, the inclination angle is within a range about 15 to 45 degrees. More preferably the inclination angle 54 is between 20 and 30 degrees. The specification inclination angle for the cooling holes 30 is maintained for each of the cooling holes 30 disposed within the liner assembly 15 according to this invention.

Figure 4B:
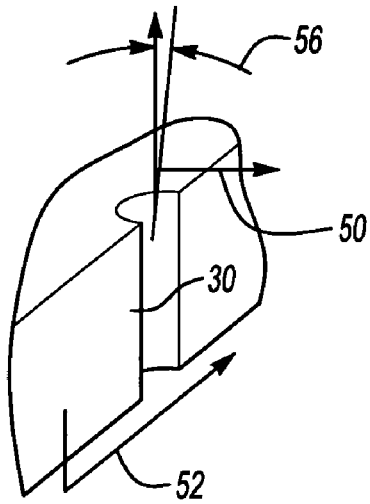
FIG. 4*b* is a cooling hole angled in a circumferential direction within a liner wall according to this invention.

Referring to FIG. 4*b*, each of the cooling holes 30 are also disposed at a circumferential or clock angle 56 that is transverse to the axis 18. The clock angle 56 can vary by as much as 90 degrees relative to the axis 52.

The cooling holes 30 include a diameter of approximately 0.02-0.03 inches and are arranged with circumferential and axial spacing of between 2 to 10 hole diameters. Similar spacing both axially and circumferentially form a geometrically uniform pattern. The regular and repeatable cooling hole spacing works well in many regions of the liner assembly. However, in regions of the liner assembly that are located proximate to structural features such as the dilutions holes 32, rails 38 and seams 40 that may suffer a loss of cooling film effectiveness require a different cooling hole angular orientation. A non-uniform cooling hole array in these regions is provided to control temperatures in the heat shield 26 proximate the dilution openings 32, the rail assemblies 38 and the seams 40.

Figure 5:
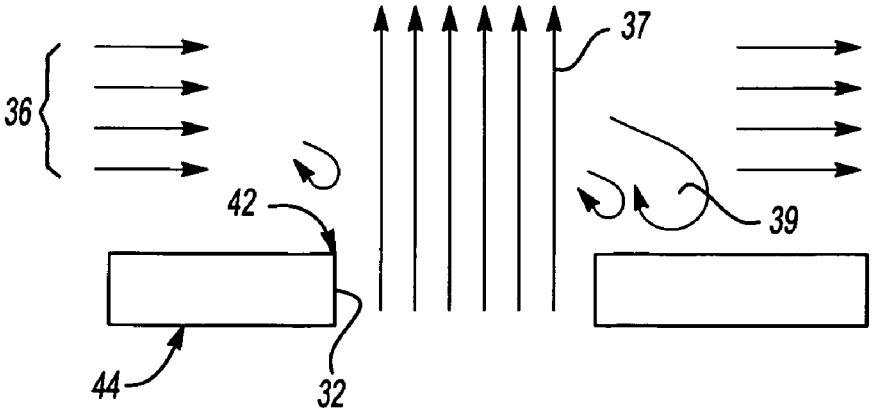
FIG. 5 is a schematic representation of the effects of three-dimensional flow through openings within a liner wall according to this invention.
Figure 6:
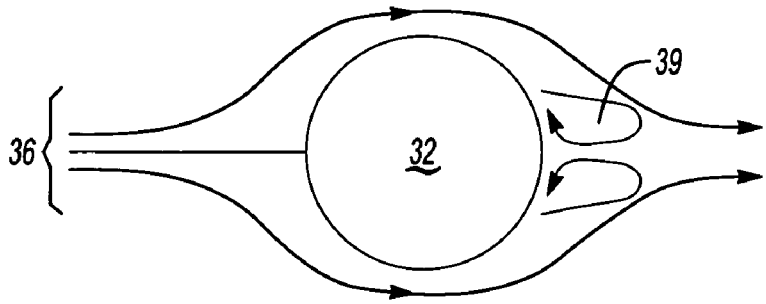
FIG. 6 is another schematic representation of coolant airflow around a dilution hole according to this invention.

Referring to FIGS. 5 and 6, compressed air flow flowing through larger openings such as the dilution opening 32 can generate three-dimensional airflows along the hot side surface 42. Three-dimensional airflow schematically indicated at 37 disrupts cooling airflow 36 adjacent the surfaces of the inner and outer heat shield 26, 28. Flow 37 through the dilution openings 32 causes the cooling airflow 36 to stagnate and generates three-dimensional or recirculating flows indicated at 39. Three-dimensional recirculating flows drive cooling air 36 away from the surface areas in the vicinity of the larger dilution openings 32 and locally depress or siphon cooling airflow away from the cooling holes. These factors reduce cooling effectiveness around the cooling hole feature and dilution openings 32. The upstream airflow migrates around the air flow 37 is at a significant momentum to produce complex gradients that reduces cooling effectiveness.

Figure 7:
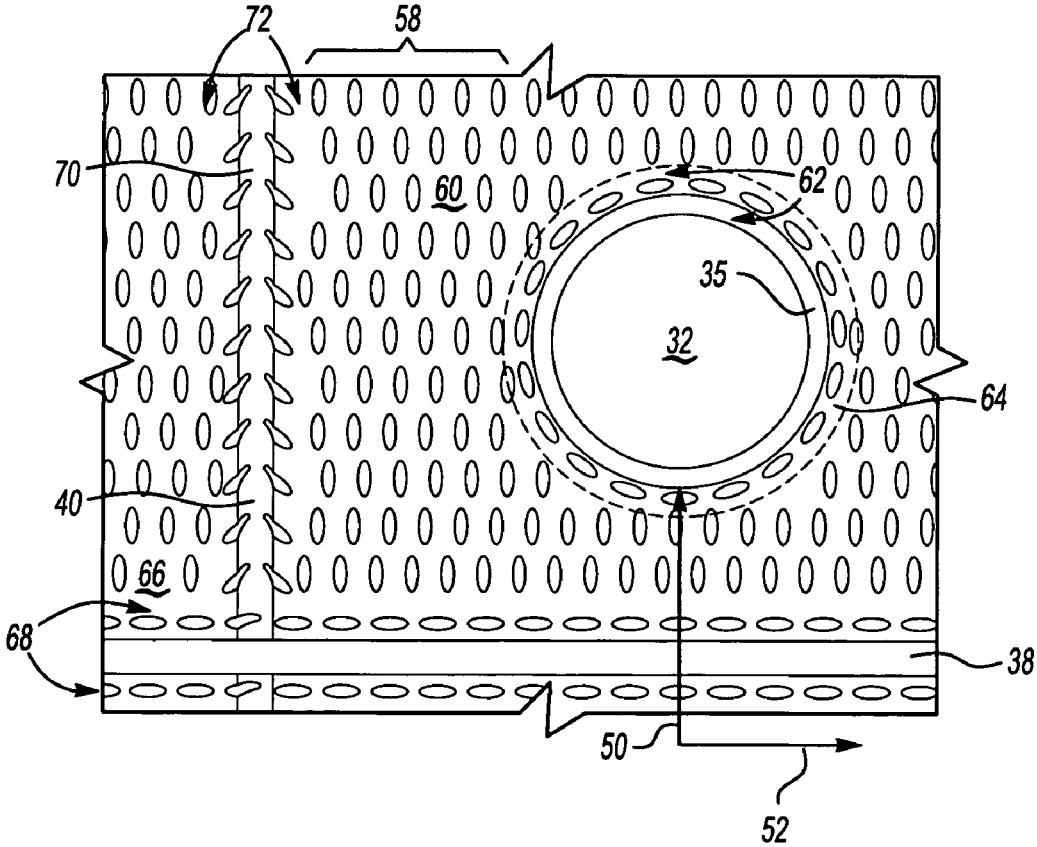
FIG. 7 is a schematic representation of a portion of the liner assembly according to this invention.

Referring to FIG. 7, the liner assembly 15 includes a non-uniform grouping of cooling holes proximate to the structural features that can potentially disrupt cooling airflow. The first group 58 of cooling holes 30 is disposed within the first region 60. The first region 60 is disposed in locations throughout the liner assembly and comprises the majority of cooling holes 30 within the heat shields 26, 28 that are not adjacent to structural features causing airflow disruption. In the first group 58, in the first region 60, the cooling holes 30 are disposed in a uniform repeating geometric pattern. Each of the cooling holes 30 within the first group 58 includes an identical inclination angle 54 and circumferential angle 56.

The inclination angle 54 and the circumferential 56 of the cooling holes 30 in the first group 58 provides the desired directional flow of cooling air along the hot side surface 42 of the heat shields 26, 28.

Between the first group 58 and structural features such as the rail 38 and flange 72 are a second group 62 of cooling holes 30. The second group 62 is disposed in a second region 64 between the first region 60 and the dilution opening 32.

The dilution opening 32 is most often accompanied by a grommet 35 that increases the thickness proximate the dilution opening 32. The grommet 35 provides an isolating chamber for the dilution flow, sealing of the chamber between the liner and heat shield and a standoff to maintain the gap between the liner and heat shield. In the second region 64, the second group of cooling holes 30 include an inclination angle 54 equal to those of the inclination angle 54 of the first group 58.

The circumferential angle of the second group 62 differs from the circumferential angle of the first group 58. The circumferential angle within the second group is preferably disposed such that each of the cooling holes is disposed in a tangential orientation relative to an outer perimeter 63 of the dilution opening 32. The tangential orientation of the cooling openings 30 provides a directionally non-uniform or circumferential cooling airflow about the perimeter 63 of the dilution opening 32. The directional flow of cooling air 36 proximate to the dilution opening 32 provides the desired accommodation for cooling airflow that provides uniform temperatures within the heat shield 26.

A third region 66 is disposed between the first region 60 and the rail 38. The rail 38 is an area of increased thickness that also requires preferential and non-uniform cooling with respect and compared to the first group 60. The third group 68 is disposed between the first group 60 and the rail assembly 38. In the third group, the cooling holes 30 are disposed at a uniform circumferential angle along the rail 38. The circumferential angle of the cooling holes 30 in the third group 68 is different than those in the first group 60. The circumferential angle of the third group 68 of cooling holes is substantially parallel to the rail assembly 38 to direct cooling airflow 36 across the rail.

A fourth group 72 is disposed within a fourth region 70 that is disposed between the first group 60 and the seam 40. About the seam 40 each of the cooling holes 30 are alternately disposed at a circumferential angle different than an immediately adjacent cooling hole 30. In the illustrative embodiment each of the cooling holes 30 are disposed at an angle that crosses at an outer boundary of the seam 40. The cooling holes 30 are disposed with circumferential angles disposed in an opposing manner to the circumferential angle of cooling holes 30 disposed on an opposite side of the seam 40. The alternating pattern of cooling hole 30 angles provides cooling airflow 36 longitudinally along the seam 40 with a hole density substantially equal to the density of the first group 58. This provides the preferential direction of the cooling air required for the non-uniform thickness within the seam area 40.

Circumferential orientation and these non-uniform regions may vary by as much as 180 degrees with cooling holes 30 that are preferentially positioned. The inclination angle of these holes is similar to those of adjacent grouping and within a tolerance of +−5 degrees. The use of the same hole diameter and minimal changes to the inclination angle permits machining operations to be performed continually without requiring additional set up operations. This also provides for the increased cooling effectiveness that accommodates added mass proximate the rail 38 and seam 40 along with accommodating three dimensional flows produced by larger dilution openings 32.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A liner assembly comprising:

a liner including an inner surface having at least one cooling airflow disrupting structure;

a first group of cooling holes formed in said liner having a first circumferential angle and first inclination angle relative to a surface of said liner, said first group of cooling holes spaced a distance apart from said cooling airflow disrupting structure; and a second group of cooling holes disposed within a region between said first group of cooling holes and said cooling airflow disrupting structure, wherein each of said second group of cooling holes is disposed in a second circumferential angle different than said first circumferential angle and a second inclination angle equal to said first inclination angle.

2. The assembly as recited in claim 1, wherein said cooling airflow disrupting structure comprises an opening for emitting a flow stream through said liner assembly wherein said second circumferential angle is different for each of said second group of cooling holes proximate said opening.

3. The assembly as recited in claim 2, wherein said opening is circular and at least some of said second group of cooling holes includes a circumferential angle substantially tangent to a perimeter of said opening.

4. The assembly as recited in claim 3, wherein at least some of said group of cooling holes is disposed adjacent a perimeter of said opening.

5. The assembly as recited in claim 1, wherein said cooling airflow disrupting structure comprises a rail, wherein said second group of cooling holes are disposed across said rail.

6. The assembly as recited in claim 5, wherein said rail defines a perimeter and said second group of cooling holes are disposed at least partially within said perimeter.

7. The assembly as recited in claim 5, wherein at least some of said second group of cooling holes comprise a circumferential angle that is disposed relative to a perimeter of said rail.

8. The assembly as recited in claim 1, wherein said s cooling airflow disrupting structure comprises a linear flange and said second group of cooling holes includes a common circumferential angle that is different than said first circumferential angle.

9. The assembly as recited in claim 1, wherein said first group of cooling holes includes a substantially equal spacing circumferentially and linearly, and said second group of cooling holes includes a substantially non-equal spacing circumferentially and axially.

10. A liner assembly for a gas turbine engine comprising:

a surface defining a gas flow path and including cooling air disrupting structure creating localized temperature non-uniformity within said surface;

a first plurality of cooling holes spaced apart to define a first hole density, wherein each of said first plurality of cooling holes include a first inclination angle relative to a longitudinal axis, and a first circumferential angle transverse to said longitudinal axis; and a second plurality of cooling holes disposed between said first plurality of cooling holes and said cooling air disrupting structure , said second plurality of cooling holes spaced apart at a hole density substantially equal to said first hole density, wherein each of said second plurality of cooling holes includes a second inclination angle substantially equal to said first inclination angle and a second circumferential angle different than said first circumferential angle.

11. The assembly as recited in claim 10, wherein said second circumferential angle is disposed relative to said cooling air disrupting structure.

12. The assembly as recited in claim 11, wherein said cooling air disrupting structure comprises an opening, and said second circumferential angle is disposed tangentially to a perimeter of said opening.

13. The assembly as recited in claim 11, wherein said cooling air disrupting structure comprises a rail and said second circumferential angle is disposed parallel to said rail.

14. The assembly as recited in claim 11, wherein said cooling air disrupting structure comprises a rail and said second circumferential angle is disposed transverse to said rail.

15. The assembly as recited in claim 11, wherein said cooling air disrupting structure comprises a seam, and said second circumferential angle is disposed at an angle relative to said seam.

16. The assembly as recited in claim 15, wherein cooling holes proximate said seam are disposed at opposite angles on opposing sides of said seam.

17. A method of controlling a temperature of a liner surface proximate a cooling flow disrupting structure within the liner surface, said method comprising the steps of:

a) generating a first cooling air flow through a first plurality of cooling holes spaced apart from each other over a first area to provide a first hole density;

b) generating a second cooling air flow through a second plurality of cooling holes disposed between said first plurality of cooling holes and the cooling flow disrupting structure;

c) selectively orientating a circumferential angle of each of the second plurality of cooling holes relative to the cooling flow disrupting structure;

d) maintaining the first hole density within the second plurality of cooling holes; and;

e) orientating an inclination angle for each of the first plurality of cooling holes and the second plurality of cooling holes at a substantially common direction and the first plurality of cooling holes at different circumferential angle than the second plurality of cooling holes.

18. The method as recited in claim 17, including the step of orientating the circumferential angle of the second plurality of cooling holes tangent to the structural feature.

19. The method as recited in claim 17, including the step of orientating the circumferential angle of the second plurality of cooling holes perpendicular to the structural feature.

20. A liner assembly comprising:

a liner including an inner surface having at least one dilution opening for emitting a flow of stream through said liner assembly;

a first group of cooling holes formed in said liner having a first circumferential angle and first inclination angle relative to a surface of said liner, said first group of cooling holes spaced a distance apart from said dilution opening; and a second group of cooling holes disposed within a region between said first group of cooling holes and said dilution opening, wherein each of said second group of cooling holes is disposed in a second circumferential angle different than said first circumferential angle and a second inclination angle equal to said first inclination angle.

21. A liner assembly comprising:

a liner including an inner surface having at least one seam;

a first group of cooling holes formed in said liner having a first circumferential angle and first inclination angle relative to a surface of said liner, said first group of cooling holes spaced a distance apart from said seam; and a second group of cooling holes disposed within a region between said first group of cooling holes and said seam, wherein each of said second group of cooling holes is disposed in a second circumferential angle different than said first circumferential angle and a second inclination angle equal to said first inclination angle.

* * * * *

UNITED STATES PATENT AND TRADEMARK OFFICE

CERTIFICATE OF CORRECTION

PATENT NO. : 7,631,502 B2
APPLICATION NO. : 11/302586
DATED : December 15, 2009
INVENTOR(S) : Burd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1035 days.

Signed and Sealed this

Twenty-first Day of December, 2010

David J. Kappos

David J. Kappos
*Director of the United States Patent and Trademark Office*